United States Patent [19]

Anderson

[11] 4,008,914

[45] Feb. 22, 1977

[54] SEALING DEVICES

[75] Inventor: Michael Denny Anderson, Meopham, England

[73] Assignee: Versapak (UK) Ltd, Chislehurst, England

[22] Filed: Aug. 29, 1974

[21] Appl. No.: 501,630

[30] Foreign Application Priority Data

Dec. 12, 1973 United Kingdom ..... 42891/73

[52] U.S. Cl. ..... 292/307 R; 70/68

[51] Int. Cl.² ..... B65D 55/06

[58] Field of Search ..... 70/67, 68, 422; 292/243, 282, 287, 307, 319, 320, 325, 322, 327, 284, 286, 316, 307 R; 24/205.11 L

[56] References Cited

UNITED STATES PATENTS

| | | | |
|---|---|---|---|
| 95,204 | 9/1869 | Dewe | 292/327 |
| 119,333 | 9/1871 | Dunn | 292/327 |
| 206,238 | 7/1878 | Hopkins | 292/327 |
| 555,412 | 2/1896 | Tyson | 292/320 |
| 779,032 | 1/1905 | Draudt | 70/422 |
| 1,030,458 | 6/1912 | Brooks | 292/320 |
| 2,411,115 | 11/1946 | Rifkin | 24/205.11 L |
| 2,942,450 | 6/1960 | Krug | 24/205.11 L |
| 3,138,842 | 6/1964 | Arthur | 292/319 X |
| 3,955,842 | 5/1976 | Edwards | 292/307 R |

FOREIGN PATENTS OR APPLICATIONS

| | | | |
|---|---|---|---|
| 56,496 | 9/1952 | France | 70/67 |

*Primary Examiner*—Robert L. Wolfe
*Attorney, Agent, or Firm*—Ulle C. Linton

[57] ABSTRACT

A sealing device for reusable envelopes in which a zip is held closed by a breakable plastic seal, the disposable, breakable part of the seal being broken by rotation of a coin in a slot provided.

1 Claim, 7 Drawing Figures

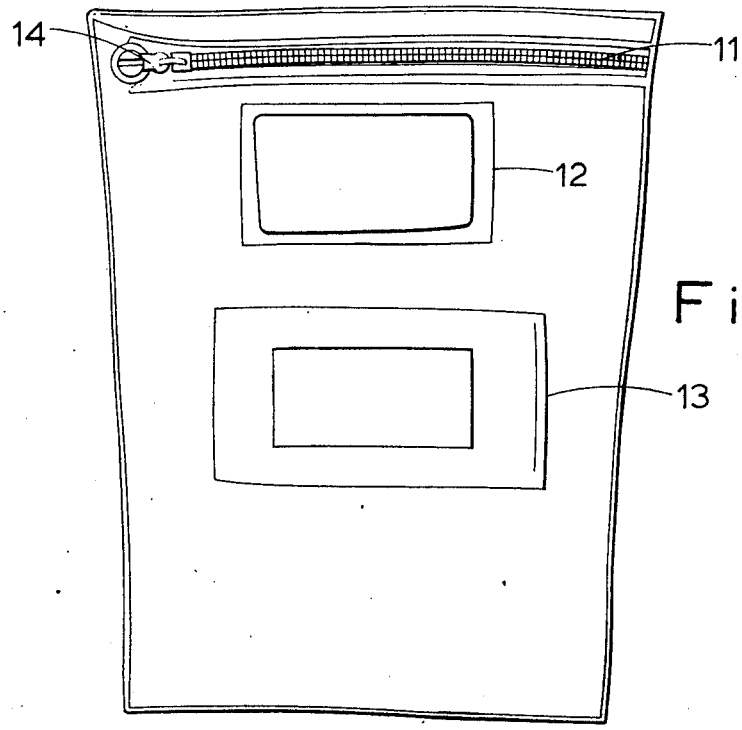
Fig. 1.
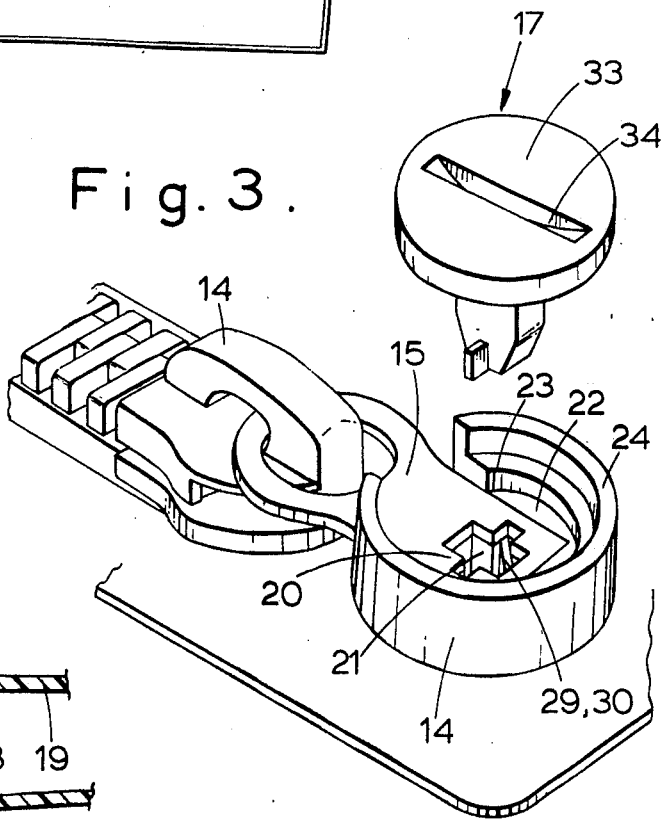
Fig. 3.
Fig. 2.
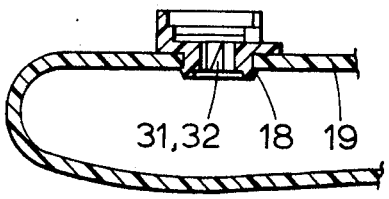

SEALING DEVICES

BACKGROUND OF THE INVENTION

The present invention relates to sealing devices including two parts, a disposable part and a part retainable for reuse, the disposable part being engageable with the retainable part to close the sealing device and being disengageable to open the sealing device, the disposable part being broken, deformed or otherwise damaged during disengagement so as not to be re-usable.

Seals are known which are opened manually by breaking the disposable part of the seal and these have been generally successful. However, it has been found that very often the amount of manual force required to break the disposable part of the seal has been higher than is desirable particularly for female operators, and if the disposable part of the seal is weakened further to make it easier to break the seal, then it is found that the seals are sometimes broken during rough handling in transit.

SUMMARY OF THE INVENTION

The present invention provides a sealing device including two parts, a disposable part and a part retainable for reuse, the disposable part being engageable with the retainable part to close the sealing device and being disengageable to open the sealing device, the disposable part including means engageable with a coin to disengage it from the retainable part, the retainable and disposable parts being arranged so that the disposable part in use, is broken, deformed or otherwise damaged during disengagement so as not to be reusable. It is preferred to provide such a simple arrangement since a coin is always readily available and a special tool is not necessary.

Preferably the means engageable with a coin comprises a slot.

It may be arranged that to close the seal, the disposable part is insertable into the retainable part and in this case it may be arranged that a head portion of the disposable part protrudes from the retained part when the sealing device is closed, the slot being provided on the head portion. A tail portion of the disposable part may be held by the retainable part and restrained from a movement, such as a rotation, so that upon the head portion being rotated by the action of the coin on the protruding head, a part connecting the head and the tail portions will break to allow removal of the disposable part. It is preferred to provide the connecting part in the form of a weakened stem to facilitate this and reduce the amount of force required. It is preferred also to require a rotational movement to break the stem if the main force tending to open the sealing device is an axial force. In this way the force required to open the sealing device is less than the axial force which the sealing device will withstand in normal use.

Another feature is that the head portion of the disposable part is shaped so as to render it difficult or even impossible to open the seal by hand since if the head portion of the disposable part can be rotated or moved in the direction necessary to break the disposable part, then there is always a danger that this will accidentally happen in transit. Preferably, therefore this head portion is circular and if the head portion protrudes from the retained part when the disposable part is engaged with the retained part then the protruding head portion is as thin as possible so as to protrude to the smallest extent possible. In any case, it is preferred that the retained part of the seal includes a shroud to protect the protruding head portion of the disposable part of the seal.

The tail portion may include a portion resiliently deflectable on engagement of the disposable part and retained part to close the seal, the resilient portion latching under a fixed portion of the retained part to retain the seal closed. Preferably there are provided more than one resilient portion and these are deflected in the same direction as the disposable part of the seal is inserted into the retained part.

The invention also provides an envelope of the so-called reusable type having an opening closed by closure means such as a zip, the closure means being closed by a sealing device of the present invention. In this case, the retained part of the sealing device may be mounted on the envelope.

The present invention also provides a sealing device including two parts, a disposable part and a part retainable for reuse, resilient means being provided on the disposable part and shoulder means being provided in the retainable part, and guide means being provided in the retainable part to guide the resilient means as the disposable part is inserted into the retainable part, so that the resilient means is deflected, the resilient means latching under the shoulder means when fully inserted to prevent removal of the disposable part from the reusable part so as to close the seal, the disposable part in use being broken, deformed or otherwise damaged during disengagement so as not to be reusable.

BRIEF DESCRIPTION OF THE DRAWINGS

FIG. 1 is a front view of a reusable envelope incorporating a sealing device of the present invention;

FIG. 2 is a cross section of the retainable part of the sealing device of FIG. 1;

FIG. 3 is a general exploded view showing the sealing device of FIG. 1 before the disposable part is inserted into the retainable part;

DESCRIPTION OF PREFERRED EMBODIMENT

Figure 4:
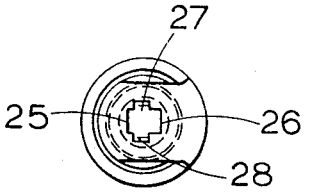
FIG. 4 is a plan view of the retainable part of the seal of FIG. 3.

FIG. 1 shows a reusable envelope 10 of one type to which the invention may be applied. The reusable envelope may be used, for example, between branches of a single business in which there is frequent correspondence between the branches. To save the cost of using new envelopes each time, an envelope of this type may be used. The envelope is generally of a plastics material and is sealed around three sides, the fourth side being openable by means of a zip fastener 11. There are provided two pockets 12 and 13 in the envelope, the pocket 12 being situated on the inner side of the envelope and having a clear plastics front face, this pocket being intended to house a card containing the address which the envelope is to be sent. The second pocket 13 is attached to the outside of the envelope 10 to carry the necessary postage.

The zip fastener 11 is closed by means of the usual closure device 14 carrying a tag 15. These are illustrated in more detail in FIG. 3.

Referring now to FIG. 3 which shows a view of the top left hand corner of the envelope of FIG. 1, it can be seen that mounted adjacent the corner of the envelope at the end of the zip 11 is a retained part 16 of a sealing device, the disposable part 17 of the device being shown above the retained part 16 before its insertion. The retained part 16 is permanently mounted on the envelope as can be seen from FIG. 2 by means of shoulders 18 which grip the underside of the top surface 19 of the envelope.

Referring again to FIG. 3, it will be seen that the tag 15 includes a generally cross-shaped slot 20 cut therethrough so that when the tag 15 is laid onto the retained part 16 the cross shaped slot 20 generally coincides with a cross shaped aperture 21 through the retained part 16. As can be seen from FIG. 2, the aperture 21 passes right through the retained part 16 and opens to the interior of the envelope 10.

The retained part 16 will be described now in greater detail. As can be seen from FIG. 3, the protruding part of the retained part 16 comprises a base surface 22 onto which the tap 15 may be laid, a further mounting surface 23 and an annular shroud 24 extending upwardly from the mounting surface 23 and spaced outwardly therefrom. The shroud 24 and mounting surface 23 have a cut out of their side adjacent the end of the zip 11 to allow the tag 15 to lay flat on the base surface 22.

The aperture 21 as mentioned above is cross shaped and two arms of the cross 25,26 which lie generally co-axial with the line of the zip fastener 11 continue with the same shape right the way through to the interior of the envelope 10. However, the other two arms 27,28 which are generally transverse the line of the zip 11 include slope portions 29,30 so that the surface of the arms 27,28 closest the zip 11 tend to move away from the zip fastener 11, as one passes down through the cross shaped aperture 21. The bottoms of the slope portions 29,30 comprise shoulders 31,32 (see FIG. 2).

Figure 5:
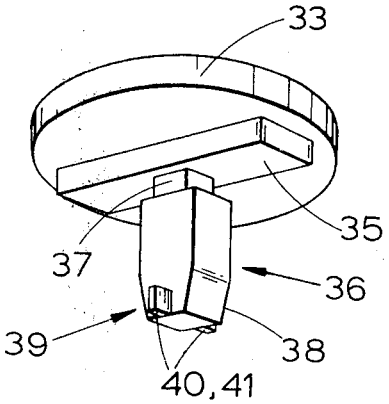
FIG. 5 is an underside view of the disposable part of the sealing device of FIG. 3.

Referring now to FIGS. 3 and 5 there is shown illustrated the disposable part 17 of the sealing device of the present invention. The disposable part 17 comprises a circular head portion 33 having a slot 34 in its top surface of a suitable size and shape to take the edge of a coin. As the thickness of the head portion 33 is small, then it has been found necessary to provide a boss 35 on the undersurface of the head portion 33 to provide sufficient depth for the slot 34 provided in the head portion 33.

Referring to FIG. 5, it can be seen that depending downwardly from the head portion 33 is a tail portion 36. The tail portion 36 is generally rectangular in cross section although having a narrowed or weakened section 37 adjacent where it meets the head portion 33. Two of the faces of the tail portion are chamfered at 38,39 to assist in guiding the tail portion 36 into the slot 20 and aperture 21. Two opposite sides of the tail portion 36 carry resilient blade like members 40,41 which extend generally normal to the surfaces to which they extend. As can be seen, therefore, the section of the tail portion 36 is generally cross shaped, and it is arranged such that the section is similar to the cross section of the slot 20 and aperture 21.

The operation of the sealing device and re-usable envelope will now be described. Material to be sent in the envelope is inserted in the envelope with the zip open, the correct address is inserted in the pocket 12 and the stamps inserted in the pocket 13.

The zip is then closed and the tag 15 laid onto the base surface 22 with its cross shaped slot 20 aligning exactly with the cross shaped aperture 21. This is the position shown in FIG. 3. The disposable part 17 is then inserted in the orientation shown in FIG. 3, so that the tail portion 36 passes through the cross shaped slot 20 and into the aperture 21. It will be appreciated that the faces 38,39 will pass through the arms 25,26 of the cross shaped aperture 21 and the blade like members 40,41 will pass through the arms 27,28 of the cross shaped aperture 21. As the disposable part 17 is pushed into the cross shaped aperture 21, it will be appreciated that the blade like members 40,41 engage the slope portions 29,30 and are resiliently deflected in the same direction away from the zip 11. As the disposable part 17 is further pushed into the cross shaped aperture 21, the blade like members 40,41 are further resiliently deflected until when the circular head portion 33 meets the mounting surface 23 on which it rests, the blade like members 40,41 clear the bottom of the slope portions 29,30 and spring back to their original positions so that they latch under the shoulders 31,32 at the bottom of the slope portions 29,30. The disposable part 17 cannot then be removed upwardly as it is securely retained by the engagement of the blade like members 40,41 with these shoulders 31,32.

Further it will be appreciated that when the circular head portion 33 is seated on the mounting surface 23, it is protected almost completely about its circumference by means of the shroud 24, the sealing device providing a substantially flush surface which cannot easily be damaged in transit.

The envelope may then be posted or otherwise sent to its destination. When it reaches its destination an operator can insert a screw driver or coin into the slot 34 and rotate the head portion 33 of the disposable part 17. The tail portion 36 is restrained from rotation by engagement of its various rectangular surfaces with the sides of the cross shaped aperture 21 and so as the head portion 33 is rotated, the narrowed section 37 fractures. This allows the head portion 33 to be moved upwardly out of the shroud 24 and the tail portion 36 falls into the interior of the envelope.

The envelope may then be opened and reused as before.

Figure 6:
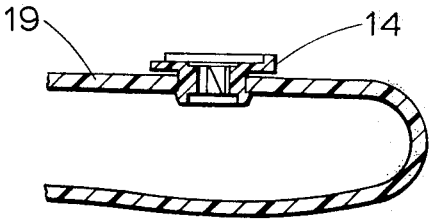
FIG. 6 is a cross-section corresponding to FIG. 2 of a second embodiment of sealing device according to the invention.
Figure 7:
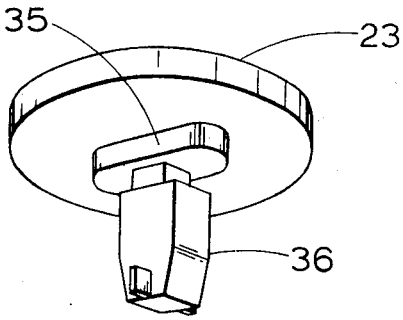
FIG. 7 is a view similar to FIG. 5 of the disposable part of the second embodiment of the sealing device similar to FIG. 5.

In the alternative embodiment shown in FIG. 6 the arrangement is almost exactly the same except that the shroud portion 24 of the retained part 16 is not present. As the head portion 33 is circular then it is unlikely that any rotation of the head portion would take place during transit and so it may be considered safe enough to allow the head portion 33 to protrude from the retained part 16. Otherwise, it is similar to the arrangement of FIG. 2. A further slight change is the difference in the shape of the boss 35 as clearly shown in the view of FIG. 7.

It will be understood that both the retained part 16 and the disposable part 17 are of a plastics material of a suitable chosen rigidity.

The invention is not restricted to the details of the foregoing examples.

I claim:

1. A sealing device comprising a disposable part and a part retainable for re-use, said disposable part comprising a head portion and a tail portion, said retainable part including an engageable portion, said tail portion being engageable in said engageable portion to close the seal while said head portion is exposed, said engageable portion and tail portion including cooperating means whereby, once engaged, they are retained together, said cooperating means comprising rotation preventing means for preventing rotation of said tail portion and resilient portions of said tail portion being resiliently deflectable in the same direction on engagement of said disposable part and said retained part, said resilient portion latching under a fixed portion of said retainable part to retain the seal closed, a coin slot means being provided on said head portion and a weakened stem portion interconnecting said head and tail portions so that rotation of said head by a coin engaging said slot causes said weakened stem portion to break to release the sealing device.

* * * * *